US007326039B2

(12) United States Patent
Kim et al.

(10) Patent No.: US 7,326,039 B2
(45) Date of Patent: Feb. 5, 2008

(54) APPARATUS FOR VARYING CAPACITY OF SCROLL COMPRESSOR

(75) Inventors: Cheol-Hwan Kim, Seoul (KR); Dong-Koo Shin, Gyeonggi-Do (KR); Hyo-Keun Park, Gyeonggi-Do (KR); Yang-Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/034,770

(22) Filed: Jan. 14, 2005

(65) Prior Publication Data

US 2006/0099097 A1 May 11, 2006

(30) Foreign Application Priority Data

Nov. 11, 2004 (KR) ..... 10-2004-0092067

(51) Int. Cl.
*F03C 2/00* (2006.01)
*F04C 18/00* (2006.01)

(52) U.S. Cl. ..... 418/55.5; 418/55.1; 418/57; 418/142; 418/152; 418/270

(58) Field of Classification Search ..... 418/55.1–55.6, 418/57, 104, 142, 152, 270
See application file for complete search history.

(56) References Cited

U.S. PATENT DOCUMENTS

| | | | | |
|---|---|---|---|---|
| 5,085,565 A | | 2/1992 | Barito | |
| 5,145,345 A | * | 9/1992 | Barito et al. | 418/55.5 |
| 5,622,488 A | | 4/1997 | Tojo et al. | |
| 6,146,119 A | * | 11/2000 | Bush et al. | 418/55.5 |
| 6,896,498 B1 | * | 5/2005 | Patel | 418/55.5 |

FOREIGN PATENT DOCUMENTS

| | | | | |
|---|---|---|---|---|
| DE | 10341104 A1 | | 3/2004 | |
| EP | 0498164 A1 | | 8/1992 | |
| EP | 1087142 A2 | | 3/2001 | |
| JP | 58160580 A | * | 9/1983 | 418/57 |
| JP | 60-247082 A | | 12/1985 | |
| JP | 60247082 A | * | 12/1985 | |
| JP | 60247082 A | * | 12/1985 | |
| JP | 03064686 A | * | 3/1991 | 418/55.5 |
| JP | 2004060535 A | * | 2/2004 | |

* cited by examiner

*Primary Examiner*—Theresa Trieu
(74) *Attorney, Agent, or Firm*—Birch, Stewart, Kolasch & Birch, LLP

(57) ABSTRACT

The present invention discloses an apparatus for varying a capacity of a scroll compressor. The apparatus comprises: a pressure control mechanism for controlling a pressure applied to the back of a orbiting scroll orbiting engaged with a fixed scroll; and a sealing varying mechanism for changing a sealing region of a orbiting scroll wrap and a sealing region of a fixed scroll wrap according to a change in the pressure applied to the back of the orbiting scroll. By this, the capacity of a refrigerant compressed by the fixed scroll and orbiting scroll using a high pressure in a casing can be varied to thus minimize the power consumption.

19 Claims, 7 Drawing Sheets

APPARATUS FOR VARYING CAPACITY OF SCROLL COMPRESSOR

BACKGROUND OF THE INVENTION

1. Field of the Invention

The present invention relates to a scroll compressor, and more particularly to, an apparatus for varying a capacity of a scroll compressor which can vary a capacity of a refrigerant compressed using a high pressure in a casing.

2. Description of the Background Art

Generally, a scroll compressor comprises: a motor mechanism mounted in a casing and for generating a rotary force; and a compression mechanism for sucking, compressing and discharging gas by receiving a driving force from the motor mechanism while a orbiting scroll is orbiting engaged with a fixed scroll.

The scroll compressor is classified into a low pressure scroll compressor in which a casing is kept in a low pressure state and a high pressure scroll compressor in which a casing is kept in a high pressure state.

In the low pressure scroll compressor, a refrigerant gas having passed through an evaporator is let into a casing, the gas let into the casing is sucked into a compression mechanism, compressed and discharged, and the refrigerant gas of high temperature high pressure state discharged from the compression mechanism is discharged to a condenser side through a discharge pipe. Due to this, the casing maintains a low pressure state.

Such a low pressure scroll compressor is provided at the tips of a fixed scroll wrap and of a orbiting scroll wrap with tip chambers for preventing gas leakage, thereby preventing the leakage of gas compressed between compression pockets formed by the fixed scroll wrap and orbiting scroll wrap.

In the high pressure scroll compressor, a refrigerant gas having passed through an evaporator is sucked directly into a compression mechanism and compressed, and the refrigerant gas compressed in the compression mechanism is discharged into a casing. The refrigerant gas of high temperature and high pressure state discharged into the casing is discharged to a condenser through a discharge pipe. Due to this, the casing maintains a high pressure state.

Such a high pressure scroll compressor is provided at the tips of a fixed scroll wrap and of a orbiting scroll wrap with no tip chambers for preventing gas leakage, and thus prevents the leakage of gas compressed between compression pockets formed by the fixed scroll wrap and orbiting scroll wrap by using a pressure of the casing of high pressure state.

FIG. 1 is a front sectional view illustrating one example of a compression mechanism of a high pressure scroll compressor. FIG. 2 is a plane view illustrating a fixed scroll wrap and a orbiting scroll wrap constituting the compression mechanism.

As illustrated therein, the compression mechanism of the scroll compressor comprises: a fixed scroll 30 mounted in a casing 10 at a predetermined gap from a main frame 20 mounted in the casing 10; a orbiting scroll 40 located between the fixed scroll 30 and the main frame 20 so as to be swivellingly engaged with the fixed scroll 30; and an Oldham's ring 50 located between the orbiting scroll 40 and the main frame 20 and for preventing the rotation of the orbiting scroll 40. The orbiting scroll 40 is connected to a rotary shaft 60, the rotary shaft being coupled to a motor mechanism.

The main frame 20 includes a frame body portion 21 having a predetermined shape, a shaft insertion hole 22 formed at the frame body portion 21 and for having the rotary shaft 60 penetrated and inserted thereinto, a boss insertion groove 23 extending from the axial insertion hole 22 and having a larger inner diameter than the shaft insertion hole 22 has, and a bearing surface 24 formed on the top surface of the frame body portion 21 and for supporting the orbiting scroll 40.

The fixed scroll 30 includes a body portion 31 formed in a predetermined shape, a wrap 32 formed on one surface of the body portion 31 in an involute curve having a predetermined thickness and height, a discharge opening 33 penetrated at the center of the body portion 31, and a suction port 34 formed at one side of the body portion 31.

The orbiting scroll 40 includes a disc portion 41 having a predetermined thickness and area, a wrap 42 formed on one surface of the disc portion 41 in an involute curve having a predetermined thickness and height, and a boss portion 43 formed at the center of the other side of the disc portion 41.

The orbiting scroll 40 is coupled between the fixed scroll 30 and the main frame 20 so that the wrap 42 is engaged with the fixed scroll wrap 32, the boss portion 43 is inserted into the boss insertion groove 23 of the main frame 20 and one surface of the disc portion 41 is supported by the bearing surface 24 of the main frame 20.

The rotary shaft 60 is penetrated and inserted into the shaft insertion hole 22 of the main frame 20 to be coupled to the boss portion 43 of the orbiting scroll 40.

A suction pipe 12 for sucking gas is penetrated and coupled to the casing 10, and the penetrated suction pipe 12 is coupled to the suction port 34 of the fixed scroll. And, a discharge pipe 13 for discharging gas is coupled to the casing 10.

Unexplained reference numeral B represents bushes and 62 represents an oil flow passage of the rotary shaft.

The operation of the compression mechanism of the high pressure scroll compressor as set forth above will be described below.

Firstly, when the rotary shaft 60 rotates by a rotary force transmitted from the motor mechanism, the orbiting scroll 40 coupled to an eccentric portion 61 of the rotary shaft swivels around the axis of the rotary shaft 60. The orbiting scroll 40 swivels as being prevented from rotation by the Oldham's ring 50.

With the orbiting scroll 40 orbiting, as the wrap 42 of the orbiting scroll swivels engaged with the wrap 32 of the fixed scroll, a plurality of compression pockets P formed by the wrap 42 of the orbiting scroll and the wrap 32 of the fixed scroll moves to the center parts of the fixed scroll 30 and orbiting scroll 40, and at the same time, as their volume changes, sucks and compresses gas and discharges it through the discharge opening 33 of the fixed scroll.

At this time, the refrigerant sucked through the suction pipe 12 is directly let into the compression pockets P through the suction port 34 of the fixed scroll, and the refrigerant of high temperature and high pressure state discharged through the discharge opening 33 of the fixed scroll passes through the casing 10 and is discharged to the outside through the discharge pipe 13.

The compression pockets P are continuously formed as the orbiting scroll 40 swivels. If the compression pockets P are located at the edge of the fixed scroll 30, they are in a low pressure state, which is a suction pressure. If the compression pockets P are located at the center of the fixed scroll 30, they are in a high pressure state, which is a discharge pressure. If they are located halfway between the edge and center of the fixed scroll 30, they are in an intermediate pressure state.

The inside of the casing 10 is always maintained in a high pressure state. By such a high pressure in the casing 10, a high pressure is applied to the back of the disc portion 41 of the orbiting scroll and thus the tip faces of the fixed scroll wrap 32 and orbiting scroll wrap 42 are closely contacted to the inner surface of the fixed scroll 30 and the disc portion 41's surface of the orbiting scroll, thereby preventing a pressure leakage between the compression pockets P formed by the wrap 42 of the orbiting scroll and the wrap 32 of the fixed scroll.

Meanwhile the aforementioned scroll compressor constitutes a cooling cycle system, and the cooling cycle system including the scroll compressor is mainly mounted to an air conditioner or the like. Upon operating the air conditioner, in order to minimize the power consumption of the air conditioner, there is a need to vary the capacity of the scroll compressor operating the cooling cycle system mounted to the air conditioner.

SUMMARY OF THE INVENTION

Therefore, an object of the present invention is to provide an apparatus for varying a capacity of a scroll compressor which can vary a capacity of a refrigerant compressed using a high pressure in a casing.

To achieve these and other advantages and in accordance with the purpose of the present invention, as embodied and broadly described herein, there is provided an apparatus for varying a capacity of a scroll compressor according to the present invention, comprising: a pressure control mechanism for controlling a pressure applied to the back of a orbiting scroll interlocked with a fixed scroll; and a sealing varying mechanism for changing a sealing region of a orbiting scroll wrap and a sealing region of a fixed scroll wrap according to a change in the pressure applied to the back of the orbiting scroll.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, a curved wafer of the present invention and a PCB coupling body for a refrigerator with the same according to an embodiment of the present invention will be described in detail with reference to the accompanying drawings.

Hereinafter, an apparatus for varying a capacity of a scroll compressor according to the present invention will be described in detail with reference to the accompanying drawings.

Figure 1:
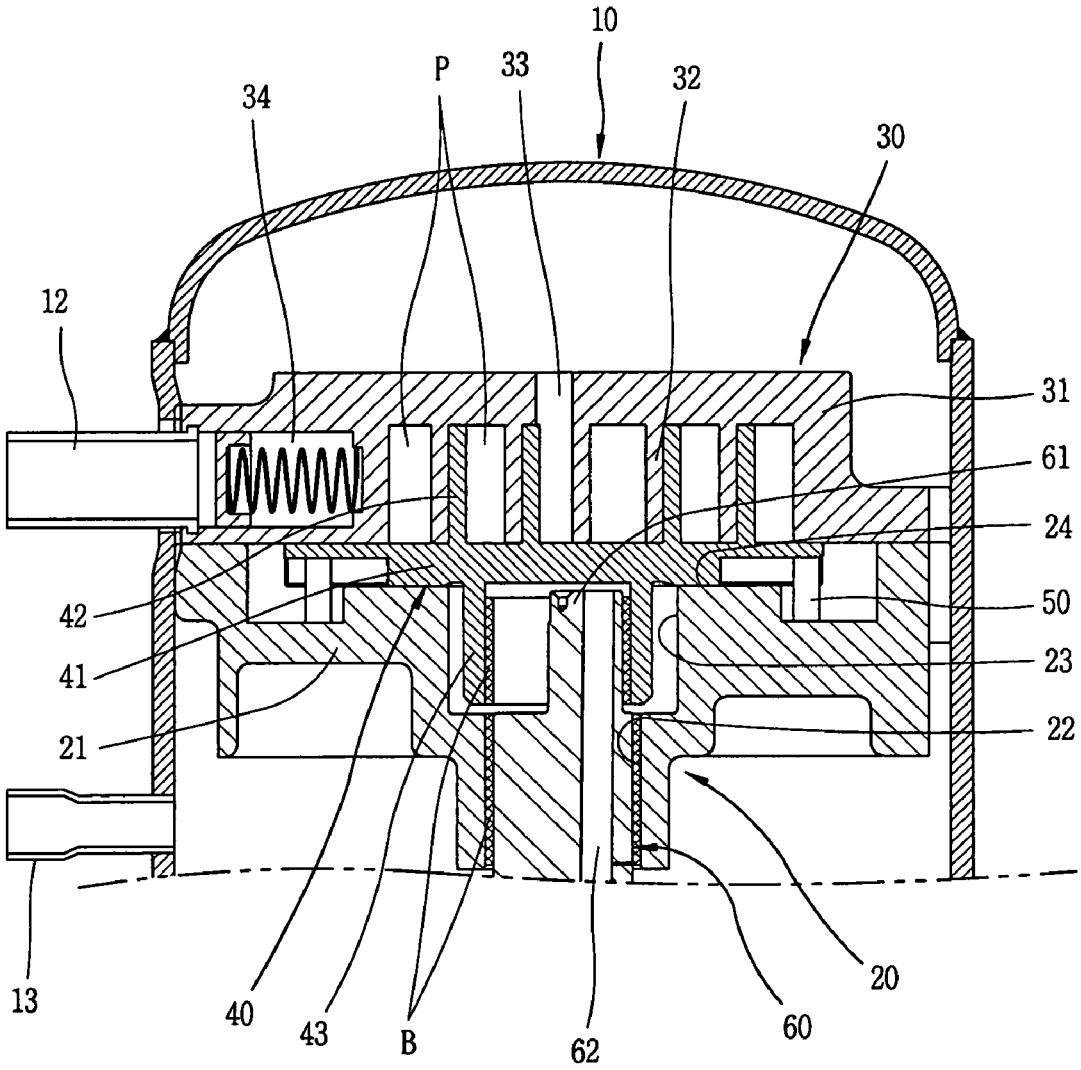
FIG. 1 CONVENTIONAL ART
FIG. 1 is a sectional view illustrating a compression mechanism of a general scroll compressor.
Figure 2:
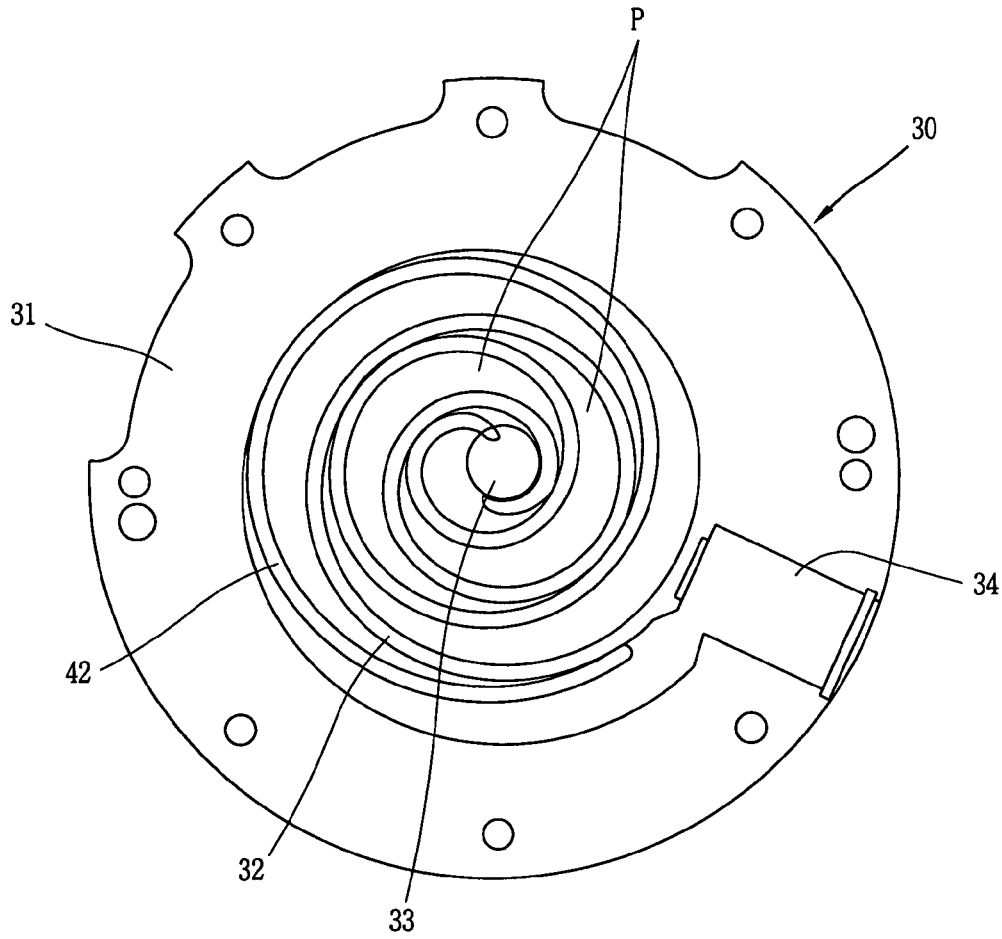
FIG. 2 CONVENTIONAL ART
FIG. 2 is a plane view illustrating a fixed scroll wrap and a orbiting scroll wrap constituting the compression mechanism of the scroll compressor.
Figure 3:
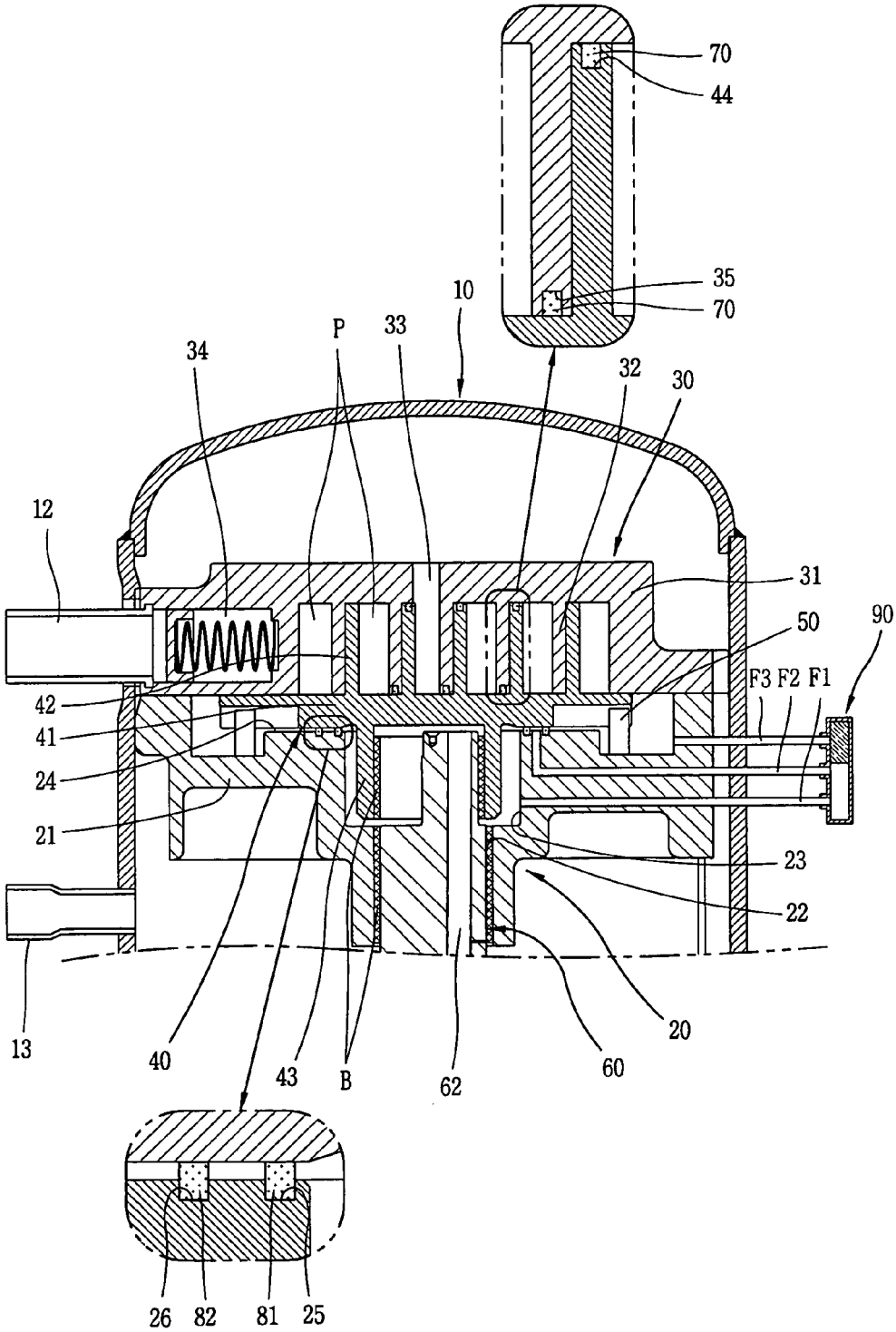
FIG. 3 is a front sectional view illustrating a compression mechanism of a scroll compressor with an apparatus for varying a capacity of a scroll compressor according to the present invention.
Figure 4:
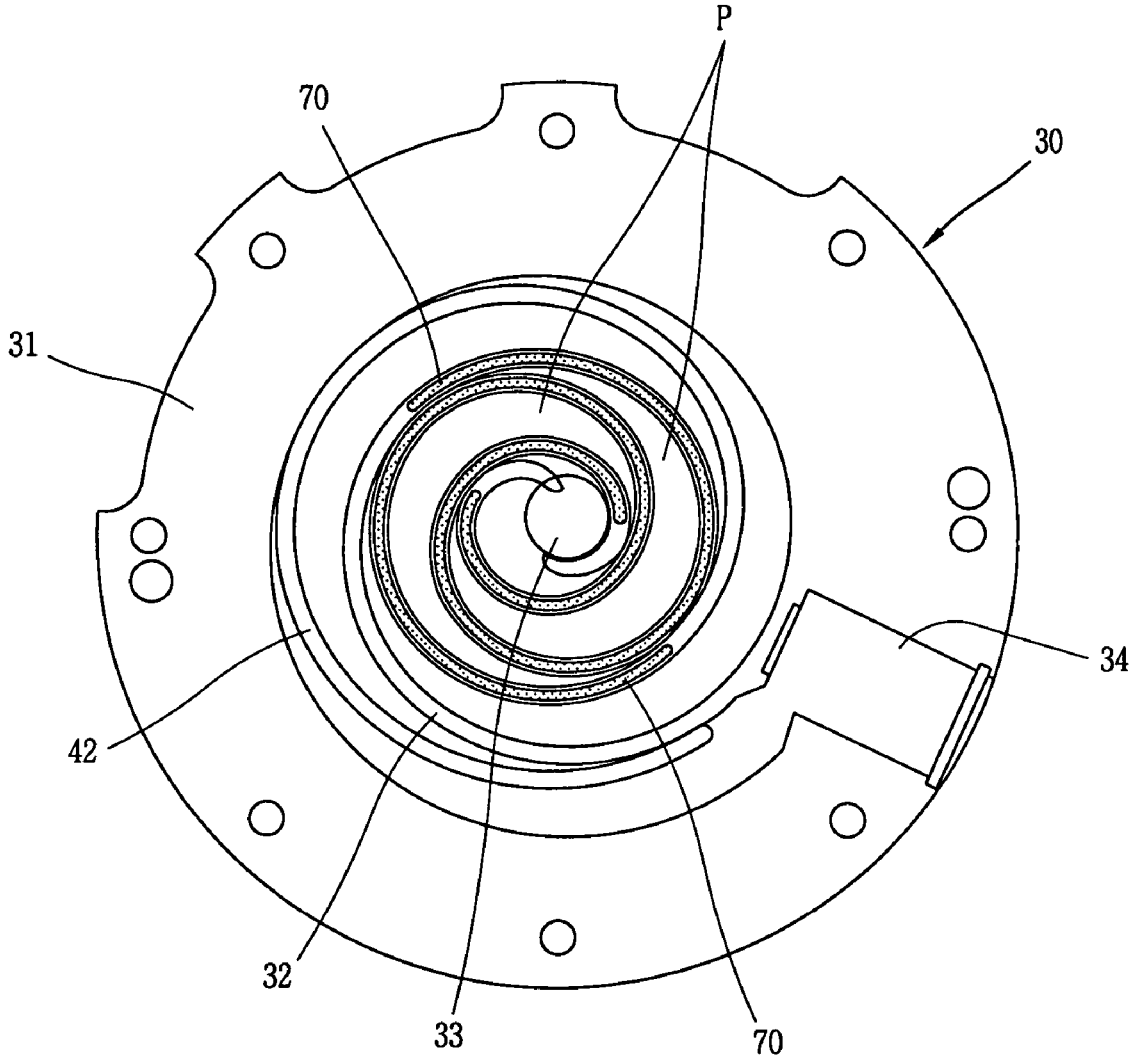
FIG. 4 is a plane sectional view illustrating the compression mechanism of the scroll compressor with the apparatus for varying a capacity of a scroll compressor according to the present invention.

FIGS. 3 and 4 are a front sectional view and plane sectional view illustrating a compression mechanism of a scroll compressor with an apparatus for varying a capacity of a scroll compressor according to one embodiment of the present invention. Same reference numerals are given to same parts as the prior part.

As illustrated therein, a main frame 20 is mounted in a casing 10 having a predetermined shape, a fixed scroll 30 is mounted to the casing 10 at a predetermined gap from the main frame 20, and a orbiting scroll 40 is located between the fixed scroll 30 and the main frame 20 so as to be swivellingly engaged with the fixed scroll 30.

The main frame 20 includes a frame body portion 21 having a predetermined shape, a shaft insertion hole 22 formed at the frame body portion 21 and for having the rotary shaft 60 penetrated and inserted thereinto, a boss insertion groove 23 extending from the shaft insertion hole 22 and having a larger inner diameter than the shaft insertion hole 22 has, and a bearing surface 24 formed on the top surface of the frame body portion 21 and for supporting the orbiting scroll 40.

The fixed scroll 30 includes a body portion 31 formed in a predetermined shape, a wrap 32 formed on one surface of the body portion 31 in an involute curve having a predetermined thickness and height, a discharge opening 33 penetrated at the center of the body portion 31, and a suction port 34 formed at one side of the body portion 31.

The orbiting scroll 40 includes a disc portion 41 having a predetermined thickness and area, a wrap 42 formed on one surface of the disc portion 41 in an involute curve having a predetermined thickness and height, and a boss portion 43 formed at the center of the other side of the disc portion 41.

The orbiting scroll 40 is coupled between the fixed scroll 30 and the main frame 20 so that the wrap 42 is engaged with the fixed scroll wrap 32, the boss portion 43 is inserted into the boss insertion groove 23 of the main frame 20 and one surface of the disc portion 41 is supported by the bearing surface 24 of the main frame 20.

The rotary shaft 60 is penetrated and inserted into the shaft insertion hole 22 of the main frame 20 to be coupled to the boss portion 43 of the orbiting scroll 40.

A suction pipe 12 for sucking gas is penetrated and coupled to the casing 10, and the penetrated suction pipe 12 is coupled to the suction port 34 of the fixed scroll. And, a discharge pipe 13 for discharging gas is coupled to the casing 10.

The casing 10 is provided inside with a pressure control mechanism for controlling a pressure applied to the back of a orbiting scroll 40 orbiting engaged with a fixed scroll 30 and a sealing varying mechanism for changing a sealing region of a orbiting scroll wrap 42 and a sealing region of a fixed scroll wrap 32 according to a change in the pressure applied to the back of the orbiting scroll.

Preferably, the sealing varying mechanism changes longitudinal sealing regions of the fixed scroll wrap 32 and orbiting scroll wrap 42.

The sealing varying mechanism includes sealing grooves 35 and 44 formed on the tip faces of the fixed scroll wrap 32 and orbiting scroll wrap 42 so as to have a predetermined thickness and length and sealing members 70 inserted into the sealing grooves 35 and 44 and sealing the surfaces facing the sealing grooves 35 and 44. The sealing grooves 35 and 44 are formed on the tip faces of the fixed scroll wrap 32 and orbiting scroll wrap 42 so as to have a predetermined length in the lengthwise direction of the wraps 32 and 42. The sealing grooves 35 and 44 are formed as far as the outside contacts of the orbiting scroll wrap 42 and fixed scroll wrap 32 forming the compression pockets of intermediate pressure state by the inside tip parts of the orbiting scroll wrap 42 and fixed control wrap 32 being contacted to each other.

The inside tips of the sealing grooves 35 and 44 are located between the inside contact of the orbiting scroll warp 42 and fixed scroll wrap 32 and the inside tips of the wraps 32 and 42.

The sealing members 70 are formed of an elastic material capable of shrinkage and relaxation.

A change of the pressure applied to the back of the orbiting scroll 40 is made by changing the area of the back of the orbiting scroll 40 in which the pressure is applied.

The pressure control mechanism includes an inner pressure ring 81 coupled to the bearing surface 24 of the main frame supporting the orbiting scroll 40 so as to surround the center of the orbiting scroll 40 with a predetermined region and for having a high pressure in the casing 10 applied to the inside thereof, an outer pressure ring 82 mounted to the bearing surface 24 so as to surround the inner pressure ring 81 and a pressure distribution control mechanism for connecting a high pressure in the inner pressure ring 81 to the inside of the outer pressuring ring 82 or connecting a low pressure of the suction port 34 side, through which a low pressure refrigerant is sucked into the orbiting scroll 40 and fixed scroll 30, to the inside of the outer pressure ring 82.

A first ring insertion groove 25 is formed in a closed curve shape on the bearing surface 24 of the main frame so as to surround the boss insertion groove 23, and the inner pressure ring 81 is coupled to the first ring insertion groove 25. And, a second ring insertion groove 26 is formed in a closed curve shape on the bearing surface 24 of the main frame so as to surround the first ring insertion groove 25, and the outer pressure ring 82 is coupled to the second ring insertion groove 26. The first and second ring insertion grooves 25 and 26 are preferably formed in a round shape.

Preferably, the inner pressure ring 81 and outer pressure ring 82 are formed of an elastic material, and the elastic coefficients of the inner pressure ring 81 and outer pressure ring 82 are different from each other.

The inner pressure ring 81 and outer pressure ring 82 coupled to the first ring insertion groove 25 and second ring insertion groove 25 of the main frame are contacted to the back of the disc portion 41 of the orbiting scroll. A high pressure in the casing 10 is transmitted to the inside of the inner pressure ring 81 through the shaft insertion hole 22 and boss insertion groove 23 of the main frame, the oil flow passage 62 penetrated into the rotary shaft 60 and so on, whereby a high pressure is always applied to the area of the back of the orbiting scroll 40 corresponding to the inner area of the inner pressure ring 81.

The pressure distribution control mechanism includes a control valve 90 for controlling the direction of a flow passage, a first flow passage F1 for connecting the control valve 90 and the inside of the inner pressure ring 81, a second flow passage F2 for connecting the control valve 90 and the inside of the outer pressure ring 82 and a third flow passage F3 for connecting the suction port 34 side and the control valve 90.

The first flow passage F1, second flow passage F2 and third flow passage F3 are formed at the fixed scroll 30. And, the control valve 90 is mounted at one side of the fixed scroll 30.

The control valve 90 is a three-way valve for selectively controlling a three-way flow passage.

In the pressure distribution control mechanism, if the first flow passage F1 and the second flow passage F2 are connected the second flow passage F2 and third flow passage F3 are shut by controlling the control valve 90, a high pressure in the casing 10 is applied to the inside of the inner pressure ring 81 and to the outer pressure ring 82 through the first and second flow passages F1 and F2. Due to this, a high pressure is applied to the area of the back of orbiting scroll 40 corresponding to the inner area of the outer pressure ring 82 including the region of the inner pressure ring 81.

If the second flow passage F2 and the third flow passage F3 are connected the first flow passage F1 and second flow passage F2 are shut by controlling the control valve 90, a low pressure of the suction port side is transmitted to the inside of the outer pressure ring 82 through the third flow passage F3 and second flow passage F2, thereby turning the inside of the outer pressure ring 82 into a low pressure state. Due to this, a high pressure is applied to the area of the back of the orbiting scroll 42 corresponding to the inner area of the inner pressure ring 81. Thus the high pressure area of the back of the orbiting scroll 40 becomes relatively smaller and accordingly a relatively smaller pressure is applied to the back of the orbiting scroll 40.

Figure 5:
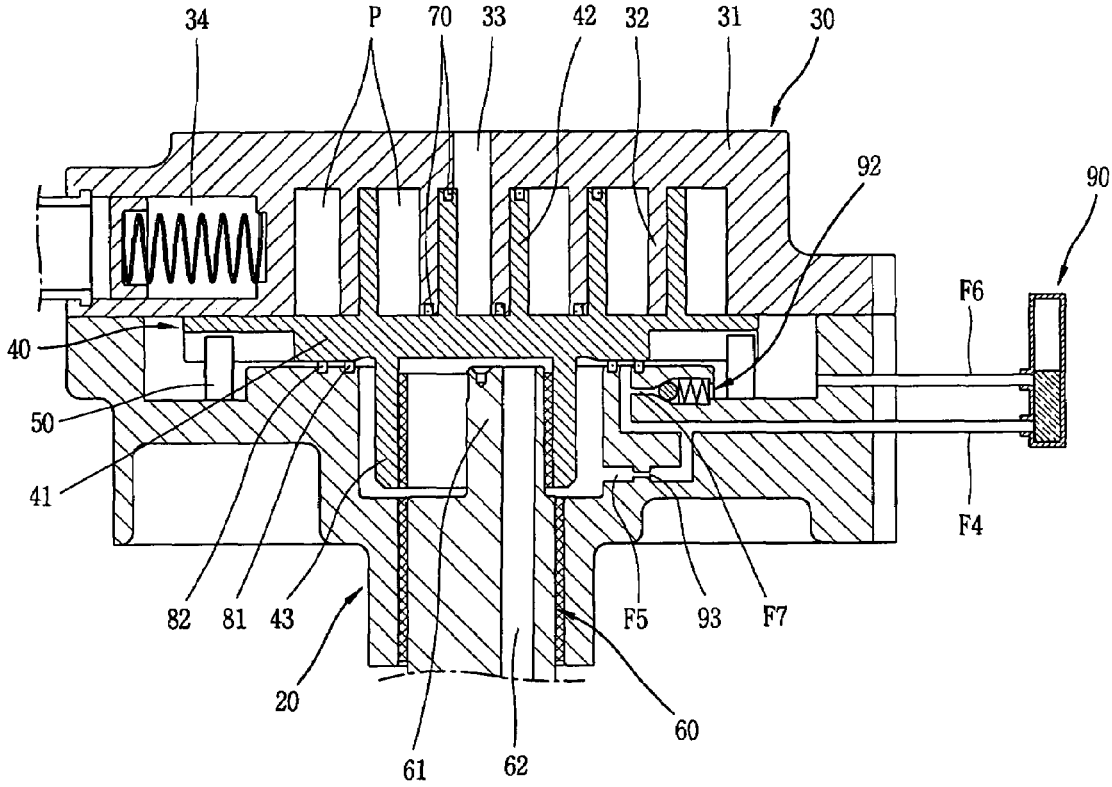
FIG. 5 is a sectional view illustrating an apparatus for varying a capacity of a scroll compressor, the apparatus being provided with a modified example of a pressure distributing mechanism constituting the apparatus for varying a capacity of a scroll compressor according to the present invention.

In a modified example of the pressure distribution control mechanism, as illustrated in FIG. 5, the pressure distribution control mechanism includes a control valve 90 for controlling the direction of a flow passage, a fourth flow passage F4 for connecting the inside of the outer pressure ring 82 and the control valve 90, a fifth flow passage for connecting the inside of the inner pressure ring 81 and the fourth flow passage F4, a sixth flow passage F6 for connecting the suction port 34 side and the control valve 90, a seventh flow passage F7 for connecting the sixth flow passage F6 and the fourth flow passage F4, a back pressure regulating valve 92 mounted to the seventh flow passage F7 and an orifice portion 93 provided at the fifth flow passage F5. The back pressure regulating valve is a general art.

The control valve 90 is a two-way valve for selectively controlling a two-way flow passage.

The fourth, fifth, sixth and seventh flow passages F4, F5, F6 and F7 are formed at the fixed scroll 30. The control valve 90 is mounted at one side of the fixed scroll 30. The orifice portion 93 is a portion where the inner diameter of some parts of the fifth flow passage F5 is smaller than the other parts.

In the pressure distribution control mechanism, if the fourth flow passage F4 and sixth flow passage F6 are shut by controlling the control valve 90, a high pressure in the internal pressure ring 81 is applied to the outer pressure ring 82 through the fifth flow passage F5, orifice portion 93 and fourth flow passage F4. At this time, the high pressure in the internal pressure ring 81 is applied to the inside of the outer pressure ring 82 through the orifice portion 93, thus a pressure of intermediate state relatively a bit smaller than the high pressure is applied. Due to this, the high pressure and intermediate pressure area of the back of the orbiting scroll 40 becomes relatively larger. In case an excessive pressure is applied to the inside of the outer pressure ring 82, the back pressure regulating valve 92 is opened.

If the fourth flow passage F4 and sixth flow passage F6 are opened by controlling the control valve 90, a low pressure of the suction port 34 side is applied to the inside of the outer pressure ring 82 through the sixth flow passage F6 and fourth flow passage F4. A high pressure in the casing 10 is applied to the inside of the internal pressure ring 81. Due to this, a high pressure is applied to the area of the back of the orbiting scroll 42 corresponding to the inner area of the inner pressure ring 81 and, accordingly a relatively smaller pressure is applied to the back of the orbiting scroll 40. At this time, a small quantity of oil is supplied between the swivel scrap wrap 42 and fixed scroll wrap 32 through the orifice portion 93.

Hereinafter, the operational effect of the apparatus for varying a capacity of a scroll compressor according to the present invention will be described.

First, the operation of the compression mechanism of the scroll compressor is similar to that as set forth above, thus a detailed description thereof will be omitted.

In case the scroll compressor is operated with a 100% capacity, as illustrated in FIGS. 3 and 5, the control valve 90 of the pressure control mechanism is controlled to apply a relatively high pressure to the back of the orbiting scroll 40 by the pressure control mechanism. By increasing the pressure area of the back of the orbiting scroll 40, as described above, a relatively high pressure is applied to the orbiting scroll 40.

With a high pressure being applied to the back of the orbiting scroll 40, the orbiting scroll 40 moves to the fixed scroll 30 side as it rises, to thus compress the tip face of the orbiting scroll wrap 42 and the inner surface of the fixed scroll 30 facing the orbiting scroll wrap 42, and at the same time compress the tip face of the fixed scroll wrap 32 and the top surface of the disc portion 41 of the orbiting scroll facing the fixed scroll wrap 32. The sealing members 70 respectively coupled to the tip faces of the fixed scroll wrap 32 and orbiting scroll wrap 42 turn into a compressed state.

This prevents a pressure leakage between the compression pockets P formed by the fixed scroll wrap 32 and the orbiting scroll wrap 42. That is, this prevents a pressure leakage between the pressure pockets P of low pressure state located at the edge of the fixed scroll 30 and the compression pockets P of intermediate pressure state located halfway between the edge and center of the fixed scroll 30. Besides, this prevents a pressure leakage between the compression pockets P of the intermediate pressure state and the compression pockets P of discharge pressures state located at the center of the fixed scroll 30.

Subsequently, the discharge pressure discharged to the discharge pipe maintains 100% of a set capacity.

Figure 6:
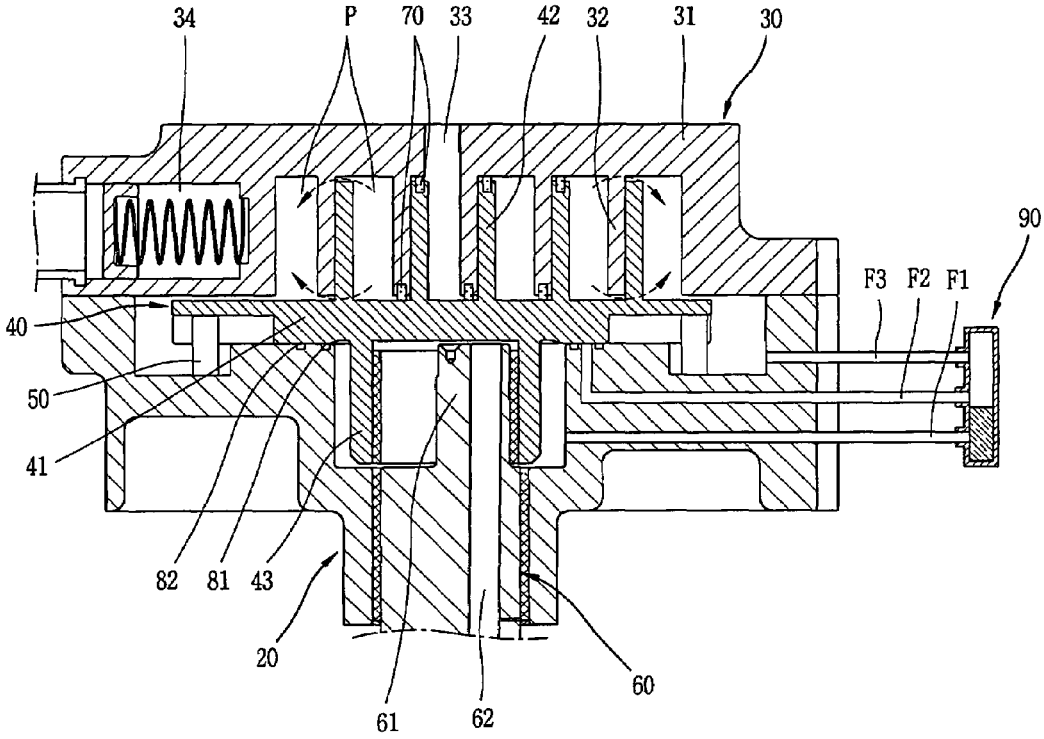
FIGS. 6 and 7 are sectional views illustrating an operating state of the apparatus for varying a scroll compressor according to the present invention.
Figure 7:
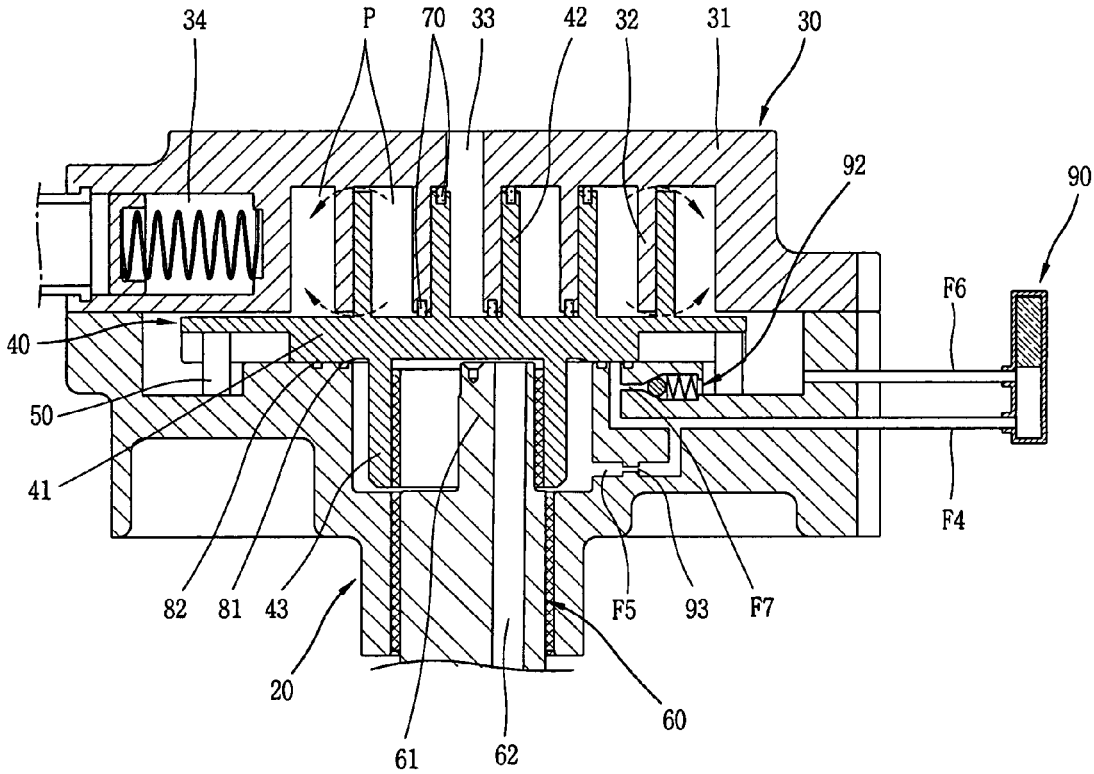

In case the scroll compressor is operated with a variable capacity, as illustrated in FIGS. 6 and 7, the control valve 90 of the pressure control mechanism is controlled to apply a relatively low pressure to the back of the orbiting scroll 40 by the pressure control mechanism. By increasing the pressure area of the back of the orbiting scroll 40, as described above, a relatively low pressure is applied to the orbiting scroll 40.

With a low pressure being applied to the back of the orbiting scroll 40, the orbiting scroll 40 moves to the main frame 20 side as the orbiting scroll 40 falls by the pressure in the fixed scroll and orbiting scroll 40, whereby a gap is between the tip face of the orbiting scroll wrap 42 and the inner surface of the fixed scroll 30 facing the orbiting scroll wrap 42, and the gap is sealed by the sealing member 70 coupled to the fixed scroll wrap 42. At the same time, a gap is produced between the tip face of the fixed scroll wrap 32 and the top surface of the disc portion 41 of the orbiting scroll facing the fixed scroll wrap 32, and the gap is sealed by the sealing member 70 coupled to the fixed scroll wrap 32.

In this way, since the fixed scroll 30 and the orbiting scroll 40 are sealed by the sealing members 70 coupled to the fixed scroll wrap 32 and orbiting scroll wrap 42, the compression pockets P located in the regions where the sealing members do not exist are communicated with each other to thus bypass a refrigerant. In other words, the compression pockets P located at the edge of the fixed scroll 30 and the compression pockets P located at the edge and center of the fixed scroll 30 are communicated with each other, thus the discharge pressure of the refrigerant discharged into the discharge opening 33 located at the center of the fixed scroll 30 are lowered and accordingly the capacity is reduced. The gap between the compression pockets P located at the edge and center of the fixed scroll 30 and the compression pockets P located at the center of the fixed scroll is sealed by the sealing members 70 to thus prevent a pressure leakage.

Subsequently, the discharge pressure discharged to the discharge pipe 13 becomes smaller than 100% of a set capacity.

Even in the case that the sealing varying mechanism is excluded and only the pressure control mechanism is provided, the compressor can be operated with a 100% capacity or can be variably operated. That is, if the pressure applied to the back of the orbiting scroll 40 is made relatively larger by the pressure control mechanism, the orbiting scroll wrap 42 and the fixed scroll wrap 32 are sealed closely contacted to their opposite face, and accordingly the scroll compressor is operated with a 100% capacity. And, if the pressure applied to the back of the orbiting scroll 40 is made relatively smaller by the pressure control mechanism, a slight gap is produced between the orbiting scroll wrap 42 and fixed scroll wrap 32 and their opposite face and this arouses a leakage between the compression pockets P of high pressure and the compression pockets P of low pressure, and accordingly the scroll compressor is operated with a variable capacity.

In this way, the apparatus for varying a capacity of a scroll compressor according to the present invention controls the pressure applied to the back of the orbiting scroll 40 using the pressure in the casing 10 maintained in a high pressure state, and varies the capacity of the scroll compressor by varying sealing regions according to the pressure applied to the back of the orbiting scroll 40.

As described above, the apparatus for varying a capacity of a scroll compressor of the present invention enables operation in various modes under the operating condition of an air conditioner having the scroll compressor mounted thereto by varying the capacity of the scroll compressor, thereby minimizing the power consumption of the air conditioner.

What is claimed is:

1. An apparatus for varying a capacity of a scroll compressor, comprising:

a pressure control mechanism for controlling a pressure applied to the back of an orbiting scroll interlocked with a fixed scroll; and a sealing varying mechanism for changing a sealing region of an orbiting scroll wrap and a sealing region of a fixed scroll wrap according to a change in the pressure applied to the back of the orbiting scroll, the sealing varying mechanism including:

sealing grooves formed on the tip faces of the fixed scroll wrap and the orbiting scroll wrap so as to have a predetermined thickness and length, the sealing grooves stopping before reaching the ends of the fixed scroll wrap and the orbiting scroll wrap; and sealing members inserted into the sealing grooves and sealing the surfaces facing the sealing grooves.

2. The apparatus of claim 1, wherein the sealing varying mechanism changes longitudinal sealing regions of the fixed scroll wrap and orbiting scroll wrap.

3. The apparatus of claim 1, wherein the sealing grooves being formed as far as the outside contacts of the orbiting scroll wrap and fixed scroll wrap forming the compression pockets of intermediate pressure state by the inside tip parts of the orbiting scroll wrap and fixed control wrap being contacted to each other.

4. The apparatus of claim 3, wherein the sealing members are formed of an elastic material so that, if a relative high pressure is applied to the back of the orbiting scroll, the sealing member is shrunken to make the tip face of the wrap contacted and sealed to the opposite face, and if a relative low pressure is applied to the back of the orbiting scroll, the sealing member is relaxed.

5. The apparatus of claim 1, wherein the inside tips of the sealing grooves are located between the inside contact of the orbiting scroll warp and fixed scroll wrap and the inside tips of the wraps.

6. The apparatus of claim 1, wherein the fixed scroll and orbiting scroll are installed in a casing and the casing has a high pressure.

7. The apparatus of claim 1, wherein a change of the pressure applied to the back of the orbiting scroll is made by changing the area of the back of the orbiting scroll in which the pressure is applied.

8. An apparatus for varying a capacity of a scroll compressor, comprising:

a pressure control mechanism for controlling a pressure applied to the back of an orbiting scroll interlocked with a fixed scroll, wherein the pressure control mechanism includes:

an inner pressure ring coupled to the bearing surface of the main frame supporting the orbiting scroll so as to surround the center of the orbiting scroll with a predetermined region and for having a high pressure in the casing applied to the inside thereof;

an outer pressure ring mounted to the bearing surface so as to surround the inner pressure ring; and a pressure distribution control mechanism for connecting a high pressure in the inner pressure ring to the inside of the outer pressuring ring or connecting a low pressure of the suction port side, through which a low pressure refrigerant is sucked into the orbiting scroll and fixed scroll, to the inside of the outer pressure ring; and a sealing varying mechanism for changing a sealing region of an orbiting scroll wrap and a sealing region of a fixed scroll wrap according to a change in the pressure applied to the back of the orbiting scroll.

9. The apparatus of claim 8, wherein the inner pressure ring and outer pressure ring are formed in a closed curve shape.

10. The apparatus of claim 8, wherein the inner pressure ring and outer pressure ring are formed of an elastic material.

11. The apparatus of claim 10, wherein the elastic coefficients of the inner pressure ring and outer pressure ring are different from each other.

12. The apparatus of claim 8, wherein the pressure distribution control mechanism comprises:

a control valve for controlling the direction of a flow passage;

a first flow passage for connecting the control valve and the inside of the inner pressure ring;

a second flow passage for connecting the control valve and the inside of the outer pressure ring; and a third flow passage for connecting the suction port 34 side and the control valve.

13. The apparatus of claim 12, wherein the control valve is a three-way valve for selectively controlling a three-way flow passage.

14. The apparatus of claim 8, wherein the pressure distribution control mechanism comprises:

a control valve for controlling the direction of a flow passage;

a fourth flow passage for connecting the inside of the outer pressure ring and the control valve;

a fifth flow passage for connecting the inside of the inner pressure ring and the fourth flow passage;

a sixth flow passage for connecting the suction port side and the control valve;

a seventh flow passage for connecting the sixth flow passage and the fourth flow passage;

a back pressure regulating valve mounted to the seventh flow passage; and an orifice portion provided at the fifth flow passage.

15. The apparatus of claim 14, wherein the control valve is a two-way valve for selectively controlling a two-way flow passage.

16. An apparatus for varying a capacity of a scroll compressor, comprising:

a pressure control mechanism for controlling a pressure applied to the back of an orbiting scroll engaged with a fixed scroll, the pressure control mechanism including:

an inner pressure ring coupled to the bearing surface of the main frame supporting the orbiting scroll for having a high pressure in the casing applied to the inside thereof;

an outer pressure ring mounted to the bearing surface so as to surround the inner pressure ring; and a pressure distribution control mechanism for connecting a high pressure in the inner pressure ring to the inside of the outer pressuring ring or connecting a low pressure of the suction port side to the inside of the outer pressure ring.

17. The apparatus of claim 16, further comprising a sealing varying mechanism for changing a sealing region of an orbiting scroll wrap and a sealing region of a fixed scroll wrap according to a change in the pressure applied to the back of the orbiting scroll.

18. The apparatus of claim 17, wherein the sealing varying mechanism includes:

sealing grooves formed on the tip faces of the fixed scroll wrap and the orbiting scroll wrap so as to have a predetermined thickness and length, the sealing grooves stopping before reaching the ends of the fixed scroll wrap and the orbiting scroll wrap; and sealing members inserted into the sealing grooves and sealing the surfaces facing the sealing grooves.

19. The apparatus of claim 16, wherein a change of the pressure applied to the back of the orbiting scroll is made by changing the area of the back of the orbiting scroll in which the pressure is applied.

* * * * *